US008576035B2

(12) United States Patent
Lin et al.

(10) Patent No.: US 8,576,035 B2
(45) Date of Patent: Nov. 5, 2013

(54) MAGNETIC FIELD GENERATING MODULE, MANUFACTURING METHOD OF MAGNETIC FIELD GENERATING MODULE, AND METHOD FOR PROMOTING MAGNETIC FORCE

(75) Inventors: Ray-Lee Lin, Tainan (TW); Sheng-Fu Hsiao, Kaohsiung (TW)

(73) Assignees: National Cheng Kung University, Tainan (TW); Delta Electronics, Inc., Taoyuan Hsien (TW)

( * ) Notice: Subject to any disclaimer, the term of this patent is extended or adjusted under 35 U.S.C. 154(b) by 97 days.

(21) Appl. No.: 13/209,995

(22) Filed: Aug. 15, 2011

(65) Prior Publication Data

US 2012/0105183 A1 May 3, 2012

(30) Foreign Application Priority Data

Oct. 29, 2010 (TW) ..... 99137296 A

(51) Int. Cl.
*H01F 7/00* (2006.01)

(52) U.S. Cl.
USPC ..... 335/296; 335/298

(58) Field of Classification Search
USPC ..... 335/296, 298
See application file for complete search history.

(56) References Cited

U.S. PATENT DOCUMENTS

| | | | | | |
|---|---|---|---|---|---|
| 1,515,500 | A | * | 11/1924 | Lee | 335/284 |
| 2,754,440 | A | * | 7/1956 | Brainard | 310/156.51 |
| 3,207,935 | A | * | 9/1965 | Mosovsky et al. | 310/172 |
| 4,162,470 | A | * | 7/1979 | Smith | 335/210 |
| 4,782,316 | A | * | 11/1988 | Domeki et al. | 335/299 |
| 5,075,814 | A | * | 12/1991 | Kubota et al. | 361/143 |
| 5,319,335 | A | * | 6/1994 | Huang et al. | 335/284 |
| 5,502,424 | A | * | 3/1996 | Kato et al. | 335/284 |
| 5,557,248 | A | * | 9/1996 | Prochazka | 335/284 |
| 5,986,376 | A | * | 11/1999 | Werson | 310/186 |
| 7,205,873 | B2 | * | 4/2007 | Dudding et al. | 335/284 |
| 7,598,633 | B2 | * | 10/2009 | Makita et al. | 310/49.23 |
| 2008/0129129 | A1 | * | 6/2008 | Kori et al. | 310/58 |
| 2012/0103348 | A1 | * | 5/2012 | Lin et al. | 128/899 |

* cited by examiner

*Primary Examiner* — Lincoln Donovan
*Assistant Examiner* — Lisa Homza
(74) *Attorney, Agent, or Firm* — Muncy, Geissler, Olds & Lowe, PLLC

(57) ABSTRACT

A magnetic field generating module includes a housing, a plurality of interpoles, a plurality of short poles and a plurality of windings. The housing has an annular section and an inner side. The interpoles disposed on the inner side in the housing are arranged around an inner periphery of the annular section with the same intervals. The short poles are disposed on the inner side in the housing and distributed between the interpoles evenly. A first interval is formed between the adjacent short poles, and a second interval equal to the first interval is formed between each of the interpoles and the adjacent short pole. The windings are respectively disposed corresponding to the interpoles and located between the interpoles and the short poles. The magnetic field generating module of the invention has more concentrated magnetic lines so as to prompt the magnetic flux density and the magnetic force.

8 Claims, 9 Drawing Sheets

MAGNETIC FIELD GENERATING MODULE, MANUFACTURING METHOD OF MAGNETIC FIELD GENERATING MODULE, AND METHOD FOR PROMOTING MAGNETIC FORCE

CROSS REFERENCE TO RELATED APPLICATIONS

This Non-provisional application claims priority under 35 U.S.C. §119(a) on Patent Application No(s). 099137296 filed in Taiwan, Republic of China on Oct. 29, 2010, the entire contents of which are hereby incorporated by reference.

BACKGROUND OF THE INVENTION

1. Field of Invention

The invention relates to a generating module, a manufacturing method of the generating module and a method for enhancing a magnetic force. In particularly, the invention relates to a magnetic field generating module, a manufacturing method of the magnetic field generating module and a method for enhancing a magnetic force.

2. Related Art

The process of targeted therapy is that injects a targeted drug into a body to attack specific cells and thus achieve the treating effect. However, the targeted drug injection disperses in the body to reduce the effect of the targeted therapy. In addition, the dispersion of the drug causes the significant side effect and another injury to the patient.

In order to improve the effect of the targeted therapy, a magnetic navigation control system combined with the targeted therapy is developed. For effective certain disease treatment, the magnetic field generating device of the magnetic navigation control system is used to generate the magnetic force for guiding a magnetic targeted drug to a target region. The technology of the magnetic navigation control system can guide the targeted drug to the target region. Thus, in addition to the treatment in the target region, the side effect on the patient is decreased, and thus the treating effect can be enhanced.

Please refer to FIGS. 1A and 1B. FIG. 1A shows a cross-sectional view of a conventional magnetic field generating module 1. FIG. 1B shows a schematic illustration of a magnetic-line distribution for the magnetic field generating module 1 in FIG. 1A. The magnetic field generating module 1 is applied to the magnetic navigation control system to generate the magnetic force for guiding the magnetic targeted drug.

The magnetic field generating module 1 includes a housing 11, three poles 121 to 123 and a plurality of windings 13. The housing 11 has an inner side 111. The poles 121 to 123 are disposed on the inner side 111 in the housing 11 with the included angle between the poles 121 to 123 at the center point being equal to 120 degrees. In addition, the windings 13 are disposed corresponding to the poles 121 to 123, respectively. Powering the windings 13 alternately can make the magnetic field generating module 1 generate the magnetic lines, as shown in FIG. 1B, in which the winding 13 corresponding to the pole 121 is powered.

However, the magnetic-line distribution for the magnetic field generating module 1 is relatively nonuniform and less concentrated. In addition, due to the magnetoresistive effect of the air, the magnetic flux density and the magnetic force are attenuated with the increment of the distance to the pole. Accordingly, the magnetic navigation effect is reduced with the increment of the distance. In order to enhance the magnetic navigation effect, the power for the winding 13 has to be increased to enhance the magnetic force; however, the cost also increases.

Therefore, in order to obtain the concentrated magnetic-line distribution and enhanced the magnetic force, to provide a magnetic field generating module, a manufacturing method for the magnetic field generating module and a method for enhancing the magnetic force is an important subject of the invention.

SUMMARY OF THE INVENTION

In view of the foregoing, to provide a magnetic field generating module, a manufacturing method for the magnetic field generating module and a method for enhancing the magnetic force, which can achieve more concentrated magnetic-line distribution, and enhanced magnetic force, is an important objective of the invention.

To achieve the above objective, the invention discloses a magnetic field generating module including a housing, a plurality of interpoles, a plurality of short poles and a plurality of windings. The housing has an annular section and an inner side. The interpoles are disposed on the inner side in the housing and have the same intervals arranged around an inner periphery of the annular section. The short poles are disposed on the inner side in the housing and evenly distributed between the interpoles. A first interval is formed between the adjacent short poles, and a second interval equal to the first interval is formed between the interpoles and the short poles adjacent to the interpole. The windings are respectively disposed corresponding to the interpoles and located between the interpoles and the short poles.

In one embodiment of the invention, the housing is a substantially hollow cylinder.

In one embodiment of the invention, the materials of the housing, the interpoles and the short poles include a magnetic-conducting material.

In one embodiment of the invention, the housing, at least one of the interpoles, and the short poles are integrally formed.

In one embodiment of the invention, when the number of the interpoles is equal to three, an included angle between the interpoles at a center point on the annular section in the housing is equal to 120 degrees.

In one embodiment of the invention, an included angle between the adjacent short poles is equal to 5, 10, 12 or 15 degrees.

In one embodiment of the invention, the number of the short poles is equal to 69, 33, 27 or 21.

In one embodiment of the invention, each of the windings has a plurality of coils located between the interpoles and the short poles.

In addition, the invention also discloses a method for manufacturing a magnetic field generating module including the following steps of: disposing a plurality of interpoles on an inner side in the housing, wherein the interpoles are arranged around an inner periphery of an annular section in the housing with the same intervals between the interpoles; disposing a plurality of short poles on the inner side in the housing, wherein the short poles are evenly distributed between the interpoles, and a first interval between the adjacent short poles is equal to a second interval between the interpoles and the short poles adjacent to the interpole; and disposing a plurality of windings respectively corresponding to the interpoles.

In addition, the invention further discloses a method for enhancing a magnetic force in a magnetic field generating module. The magnetic field generating module has a housing, which has an annular section and an inner side. A plurality of interpoles is arranged on the inner side in the housing and arranged around an inner periphery of the annular section with the same intervals between the interpoles. The magnetic field generating module further has a plurality of first windings respectively disposed corresponding to the interpoles. The method includes the following steps of: disposing a plurality of short poles on the inner side in the housing of the magnetic field generating module, wherein the short poles are evenly distributed between the interpoles, and a first interval between the adjacent short poles is equal to a second interval between the interpoles and the short poles adjacent to the interpole; and disposing a plurality of second windings respectively corresponding to the interpoles.

As mentioned above, the interpoles of the magnetic field generating module according to the invention are disposed on the inner side in the housing and have the same intervals arranged around the inner periphery of the annular section in the housing. The short poles are evenly disposed between the interpoles, the first interval is formed between the adjacent short poles, and the second interval equal to the first interval is formed between each interpole and adjacent short pole. Thus, the magnetic field generating module has the magnetic interpole structure, and the design for the short pole can decrease the magnetoresistive effect of the air between two interpoles, and improve the magnetic force attenuation of the magnetic field generating module. So that the magnetic lines generated by the winding corresponding to the interpole can be effectively extended, and the magnetic-line distribution becomes more concentrated and more uniform. Thus, the magnetic field generating module of the invention has the more concentrated and more uniform magnetic-line distribution, and can effectively enhance the magnetic flux density and the magnetic force. In addition, the manufacturing method for the magnetic field generating module and the method for enhancing the magnetic force according to the invention also have the above-mentioned structure of the magnetic field generating module. Thus, the magnetic flux density and the magnetic force are effectively enhanced.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2A:
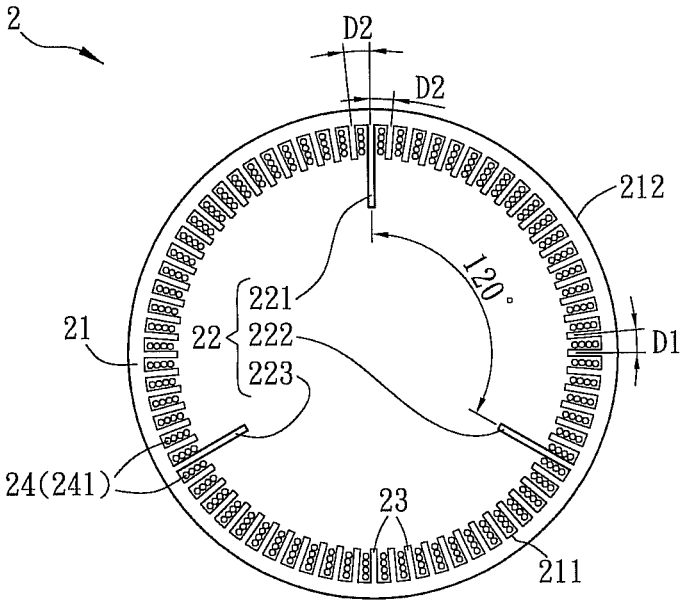
FIG. 2A shows a cross-sectional view of a magnetic field generating module in the invention.
Figure 2B:
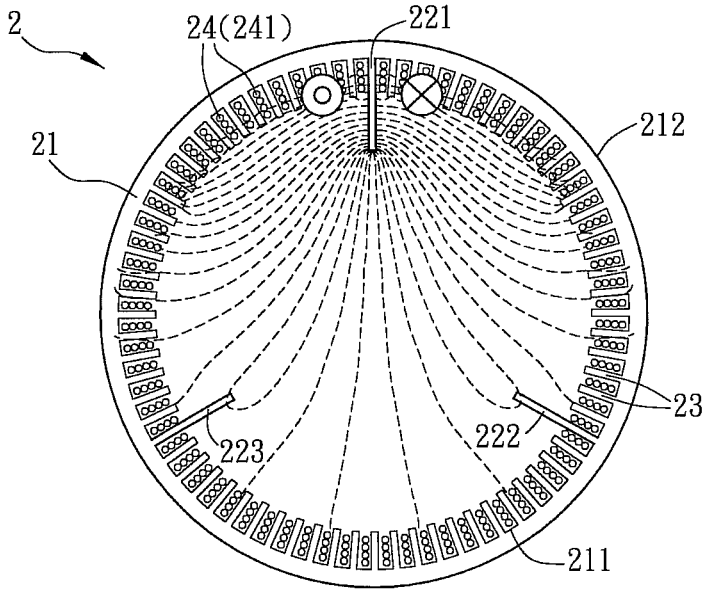
FIG. 2B shows a schematic illustration of a magnetic-line distribution for the magnetic field generating module in FIG. 2A.

FIG. 2A shows a cross-sectional view of a magnetic field generating module 2 in the invention. FIG. 2B shows a schematic illustration of a magnetic-line distribution for the magnetic field generating module 2 in FIG. 2A. Referring to FIGS. 2A and 2B, the magnetic field generating module 2 includes a housing 21, a plurality of interpoles 22, a plurality of short poles 23 and a plurality of windings 24. The magnetic field generating module 2 is applied to a magnetic navigation control system to guide a magnetic substance. The magnetic navigation control system is applied to the applications of medical targeted therapy, cardiovascular therapeutics, medical micro-machine navigation, surgical catheter orientation navigation and the like. Of course, the magnetic field generating module 2 is applied to the non-medical field.

The housing 21 has an inner side 211. Herein, the housing 21 is a substantially hollow cylinder, wherein the housing 21 has an annular section, the inner side 211 and an outer side 212.

The interpoles 22 are disposed on the inner side 211 in the housing 21 and have the same intervals arranged around the inner periphery of the annular section in the housing 21. In this illustrative embodiment, three interpoles 22 are provided. Herein, the three interpoles 22 are referred to as specific interpoles 221 to 223 evenly disposed on the inner side 211. In other words, three specific interpoles 221 to 223 of this embodiment are evenly located on the inner side 211 in the housing 21. So that included angles between any two specific interpoles (i.e., between the specific interpoles 221 and 222, between the specific interpoles 222 and 223, and between the specific interpoles 223 and 221) at the center point of the annular section in the housing 21 are equal to 120 degrees, as shown in FIG. 2A. Nevertheless, the designer may also dispose six or more than six specific interpoles on the inner side 211 according to the requirement on the magnetic force and evenly arrange the specific interpoles around the inner periphery of the annular section in the housing 21.

The short poles 23 are disposed on the inner side 211 with distributed between the interpoles 22 in the housing 21, so that the magnetic field generating module 2 has a magnetic interpole structure. In this embodiment, the number of short poles 23 is equal to 69. Since the number of interpoles 22 is equal to 3, 23 short poles 23 are evenly located between two interpoles 22. In addition, a first interval D1 is formed between two adjacent short poles 23, and a second interval D2 equal to the first interval D1 is formed between each interpole 22 and adjacent short pole 23 in the invention. Herein, the numbers of the specific interpoles 221 to 223 and the short poles 23 are equal to 72, and the first interval D1 is equal to the second interval D2. So the included angle between two adjacent short poles 23 at the center point of the annular section in the housing 21 is equal to 5 degrees (360 degrees divided by 72). The included angle between each interpole 22 and adjacent short pole 23 at the center point of the annular section in the housing 21 is also equal to 5 degrees.

The number of the interpoles and short poles are specified according to the requirement on the magnetic force. For example, three specific interpoles 221 to 223 work in conjunction with 33, 27 or 21 short poles 23. So that the included angle between two adjacent short poles 23 at the center point of the annular section in the housing 21 is equal to 10 (360 divided by 36), 12 (360 divided by 30) or 15 (360 divided by 24) degrees. Herein, the numbers of the interpoles 22 and the short poles 23 is not particularly restricted. In addition, the materials of the housing 21, the interpoles 22, and the short poles 23 include magnetic-conducting material, such as the silicon steel, amorphous alloy, ferromagnetic, ferrite, superconductor or the like. In addition, the housing 21 and at least one of the interpoles 22 or the short poles 23 are integrally formed. In this illustrative embodiment, the housing 21, the interpoles 22 and the short poles 23 are integrally formed.

The length ratio of the short pole 23 to the interpole 22 is adjustable. The designer adjusts the length ratio according to the requirement on the magnetic force. The length ratio of the short pole 23 to the interpole 22 is 0.4:1, 0.7:1 or any other ratio.

In addition, the windings 24 are respectively disposed corresponding to the interpoles 22, and located between the interpoles 22 and the short poles 23. In this embodiment, each winding 24 has a plurality of coils 241 disposed respectively corresponding to the specific interpoles 221 to 223, and respectively located between each of the specific interpoles 221 to 223 and the short poles 23. The material of the coil 241 includes, for example, copper, superconductor or any other electroconductive material and will not be particularly restricted herein.

When power is on, the magnetic-line distribution of the magnetic field generating module 2 shows in FIG. 2B for example. Wherein FIG. 2B shows the distribution when the winding 24 corresponding to the specific interpole 221 is powered on. Because the magnetic interpole structure is used in the magnetic field generating module 2, the provision of the short pole 23 can decrease the magnetoresistive effect of the air between two interpoles 22, and improve the magnetic force attenuation for the magnetic field generating module 2. So that the magnetic lines generated by the winding 24 corresponding to the interpole 22 can be effectively extended. Thus, the magnetic-line distribution of the magnetic field generating module 2 becomes more concentrated and more uniform.

Figure 1A:
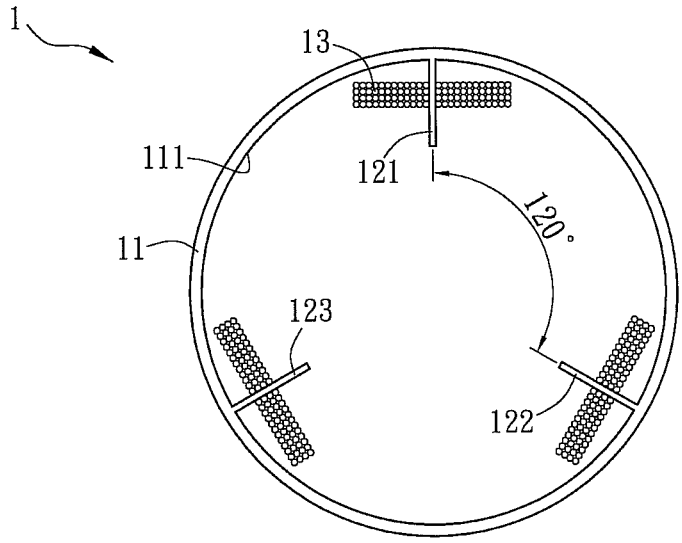
FIG. 1A(Prior Art)
FIG. 1A shows a cross-sectional of a conventional magnetic field generating module.
Figure 1B:
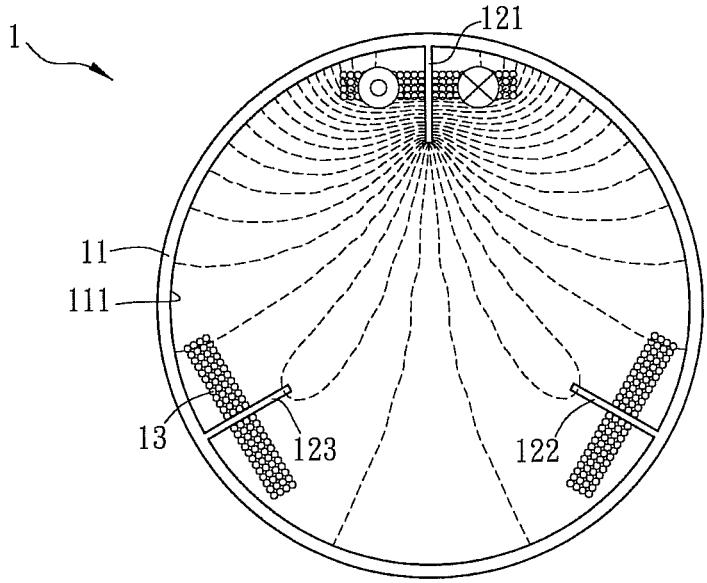
FIG. 1B(Prior Art)
FIG. 1B shows a schematic illustration of a magnetic-line distribution for the magnetic field generating module in FIG. 1A.

Comparing the magnetic-line distribution in FIG. 2B with FIG. 1B, the magnetic field generating module 2 in FIG. 2B has the more uniformly distributed and more concentrated magnetic lines than FIG. 1B.

Figure 3A:
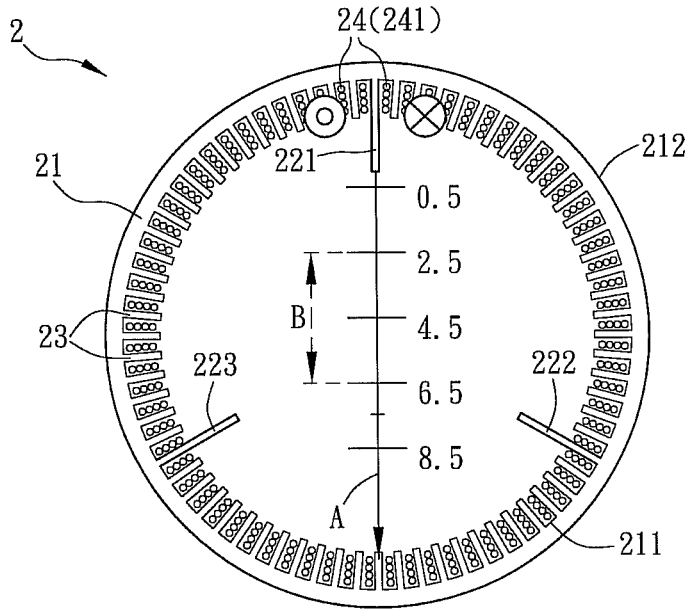
FIG. 3A shows a cross-sectional view of the magnetic field generating module in the invention.
Figure 3B:
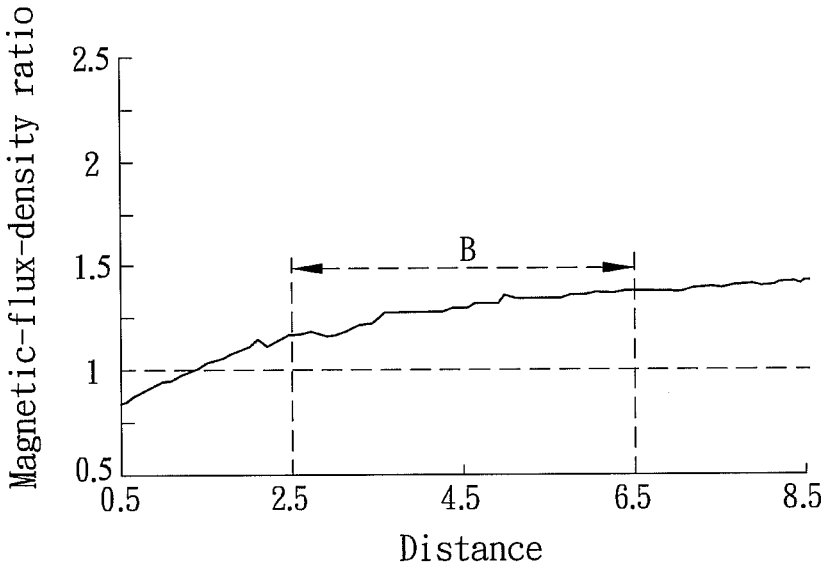
FIG. 3B shows a schematic graph of the comparison between the magnetic flux densities for the magnetic field generating module in the invention and the conventional magnetic field generating module.

FIG. 3B shows a schematic illustration of the comparison between the magnetic flux densities for the magnetic field generating module 2 in the invention and the conventional magnetic field generating module 1. The horizontal coordinate of FIG. 3B represents the distance between a certain position on the straight line A in FIG. 3A and the top end of the specific interpole 221. Herein, the vertical coordinate in FIG. 3B represents the ratio of the magnetic flux density for the magnetic field generating module 2 in the invention to the magnetic flux density of the conventional magnetic field generating module 1.

As shown in FIG. 3B, the ratio of the magnetic flux density becomes higher as the distance from the top end of the specific interpole 221 gets longer. In other words, as the distance from the specific interpole 221 gets longer, the improvement on the magnetic flux density of the magnetic field generating module 2 becomes greater than that of the prior art. In addition, in a working region B with the distance ranging from 2.5 to 6.5 units, the magnetic flux density of the magnetic field generating module 2 is equal to 1.2 to 1.4 times of that of the magnetic field generating module 1. In addition, the magnetic field generating module 2 has the symmetrical structure. So, in the same condition, the magnetic flux densities corresponding to the specific interpoles 222 and 223 comparing with the prior art is similarly enhanced.

Figure 4A:
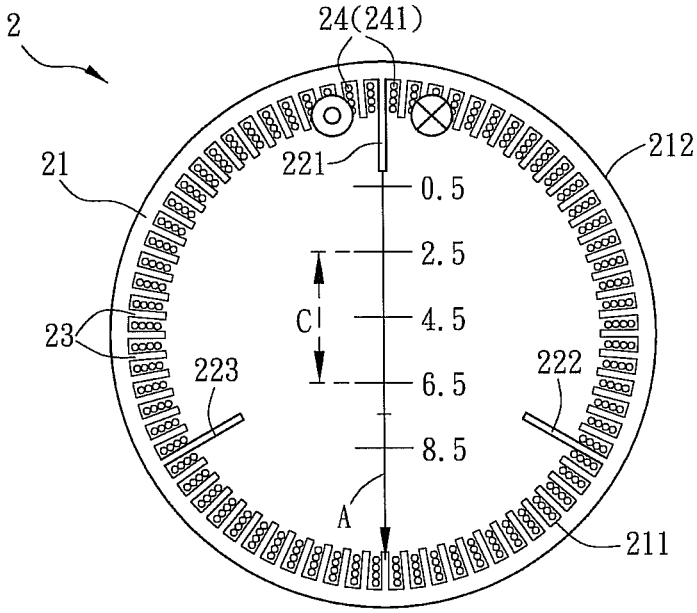
FIG. 4A shows a cross-sectional view of the magnetic field generating module in the invention.
Figure 4B:
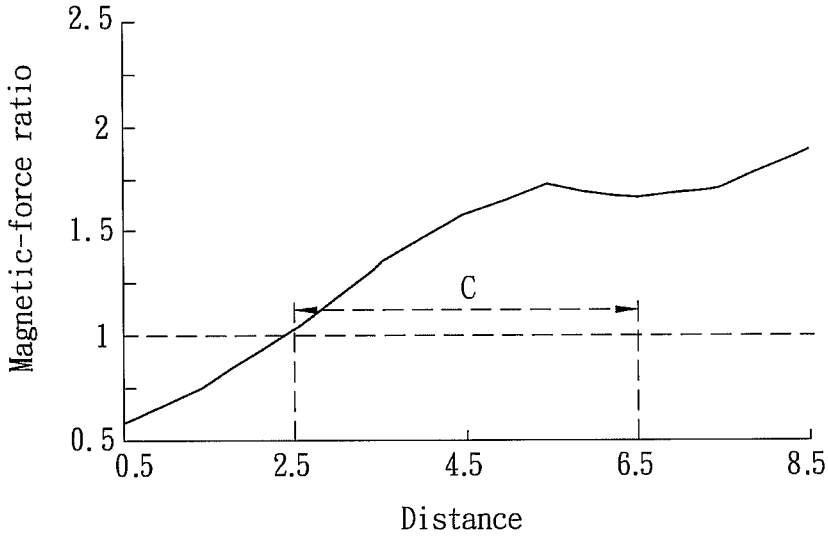
FIG. 4B shows a schematic graph of the comparison between the magnetic forces for the magnetic field generating module in the invention and the conventional magnetic field generating module.

Furthermore, FIG. 4B shows a schematic illustration of the comparison between the magnetic forces for the magnetic field generating module 2 in the invention and the magnetic field generating module 1. The horizontal coordinate of FIG. 4B represents the distance between a certain position on the straight line A in FIG. 4A and the top end of the specific interpole 221. Herein, the vertical coordinate in FIG. 4B represents the ratio of the magnetic force for the magnetic field generating module 2 in the invention to the magnetic force for the magnetic field generating module 1.

As shown in FIG. 4B, in a working region C with the distance ranging from 2.5 to 6.5 units, the magnetic force for the magnetic field generating module 2 is equal to 1.0 to 1.6 times of the magnetic force of the magnetic field generating module 1. In addition, the magnetic field generating module 2 has the symmetrical structure. So, in the same condition, the magnetic flux densities corresponding to the specific interpoles 222 and 223 comparing with the prior art is similarly enhanced.

Figure 5A:
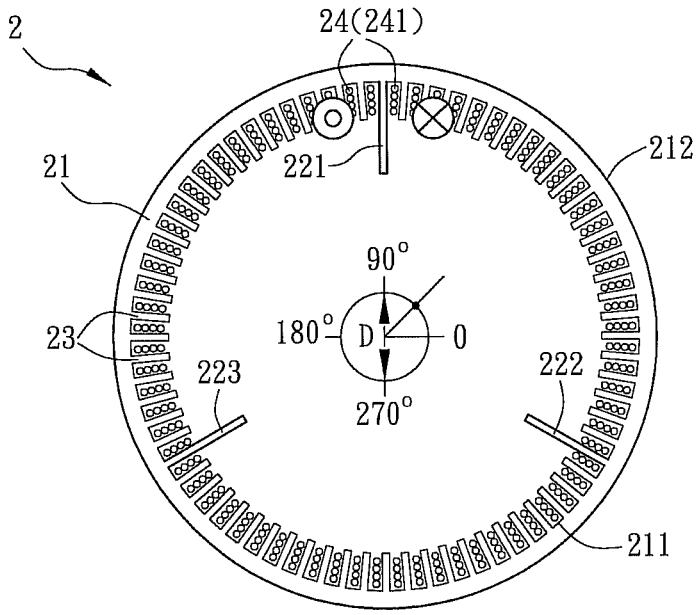
FIG. 5A shows a cross-sectional view of the magnetic field generating module in the invention.
Figure 5B:
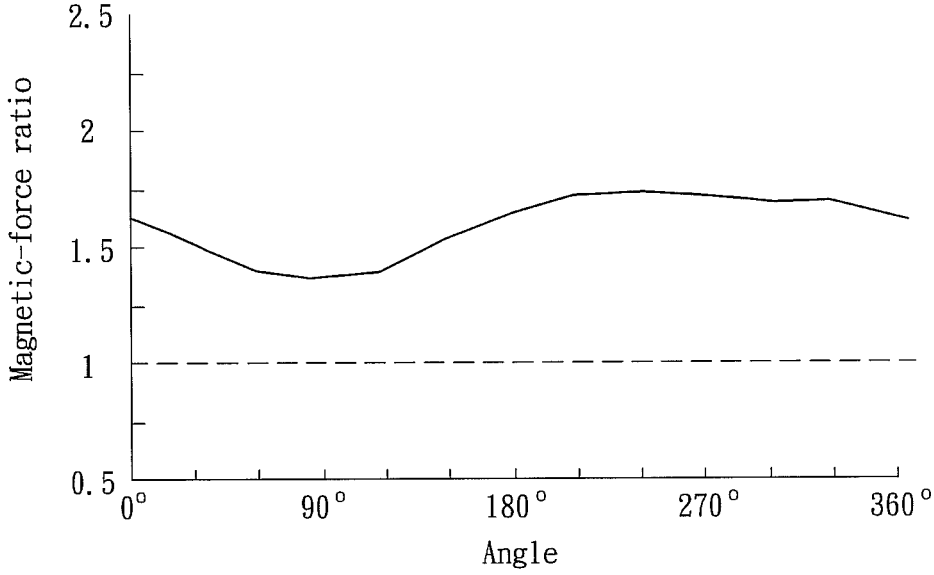
FIG. 5B shows a schematic graph of the comparison between the magnetic forces for the magnetic field generating module in the invention and the prior art at different azimuths on a circumference of a circle D with a radius equal to 2 units.

FIG. 5B shows a schematic illustration of the comparison between the magnetic forces for the magnetic field generating module 2 in the invention and the conventional magnetic field generating module 1 at different azimuths on a circumference of a circle D with a radius equal to 2 units. The horizontal coordinate in FIG. 5B represents the angle on the circumference of the circle D in FIG. 5A. While the vertical coordinate in FIG. 5B represents the ratio of the magnetic force for the magnetic field generating module 2 in the invention to the magnetic force for the conventional magnetic field generating module 1.

As shown in FIG. 5B, the magnetic force for the magnetic field generating module 2 at the different angles on the circumference of the circle D is equal to 1.4 to 1.7 times of that of the magnetic field generating module 1. In addition, the magnetic field generating module 2 has the symmetrical structure. So, in the same condition, the magnetic flux densities corresponding to the specific interpoles 222 and 223 comparing with the prior art is similarly enhanced.

Figure 6A:
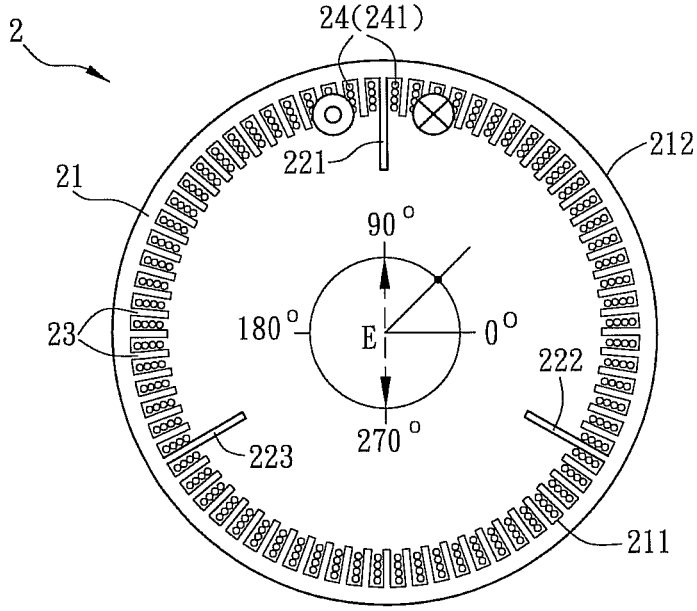
FIG. 6A shows a cross-sectional view of the magnetic field generating module in the invention.
Figure 6B:
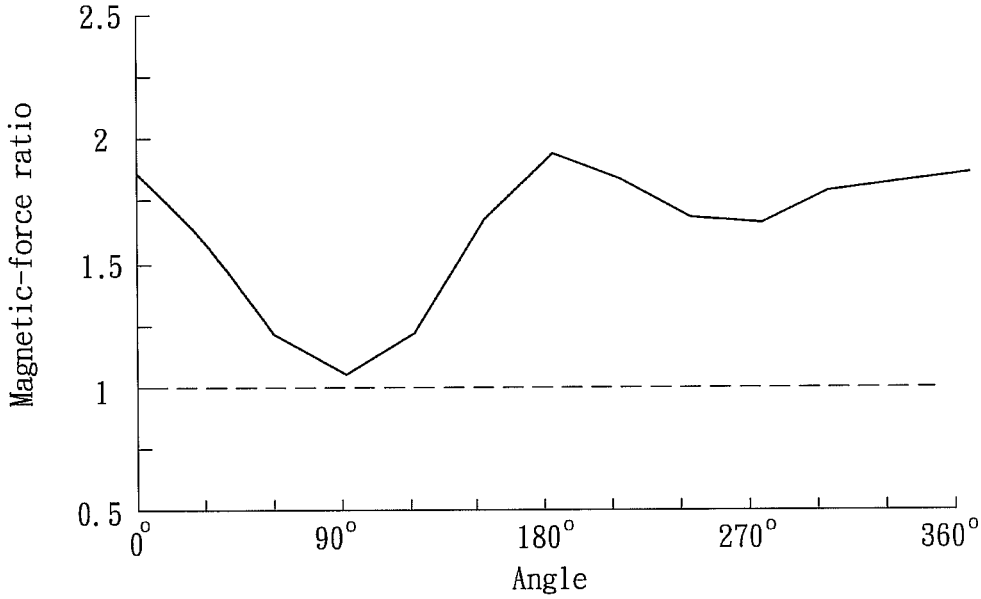
FIG. 6B shows a schematic graph of the comparison between the magnetic forces for the magnetic field generating module in the invention and the prior art at different azimuths on a circumference of a circle D with a radius equal to 4 units.

FIG. 6B shows a schematic illustration of the comparison between the magnetic forces for the magnetic field generating module 2 in the invention and the conventional magnetic field generating module 1 at different azimuths on a circumference of a circle E with a radius equal to 4 units. The horizontal coordinate in FIG. 6B represents the angle on the circumference of the circle E in FIG. 6A. Herein, the vertical coordinate in FIG. 6B represents the ratio of the magnetic force for the magnetic field generating module 2 in the invention to the magnetic force for the conventional magnetic field generating module 1.

As shown in FIG. 6B, the magnetic force for the magnetic field generating module 2 at different angles on the circumference of the circle E is equal to 1.0 to 1.9 times of that of the magnetic field generating module 1. In addition, the magnetic field generating module 2 has the symmetrical structure. So, in the same condition, the magnetic flux densities corresponding to the specific interpoles 222 and 223 comparing with the prior art is similarly enhanced.

As mentioned hereinabove, the interpoles 22 of the magnetic field generating module 2 are disposed on the inner side 211 in the housing 21 and have the same intervals arranged around the inner periphery of the annular section in the housing 21. The short poles 23 are disposed on the inner side 211 in the housing 21 and evenly distributed between the interpoles 22, the first interval D1 is formed between the adjacent short poles 23. The second interval D2 equal to the first interval D1 is formed between each interpole 22 and adjacent short pole 23 in the invention. Thus, the magnetic field generating module 2 has the magnetic interpole structure, and the design for the short pole 23 can decrease the magnetoresistive effect of the air between two interpoles 22 and improve the magnetic force attenuation for the magnetic field generating module 2. Thus, the magnetic lines generated by the winding 24 corresponding to the interpole 22 can be effectively extended, so that the magnetic-line distribution becomes more concentrated and more uniform. Thus, the magnetic field generating module 2 in the invention has the more concentrated and more uniform magnetic-line distribution, and can effectively enhance the magnetic flux density and the magnetic force in the working region.

Figure 7:
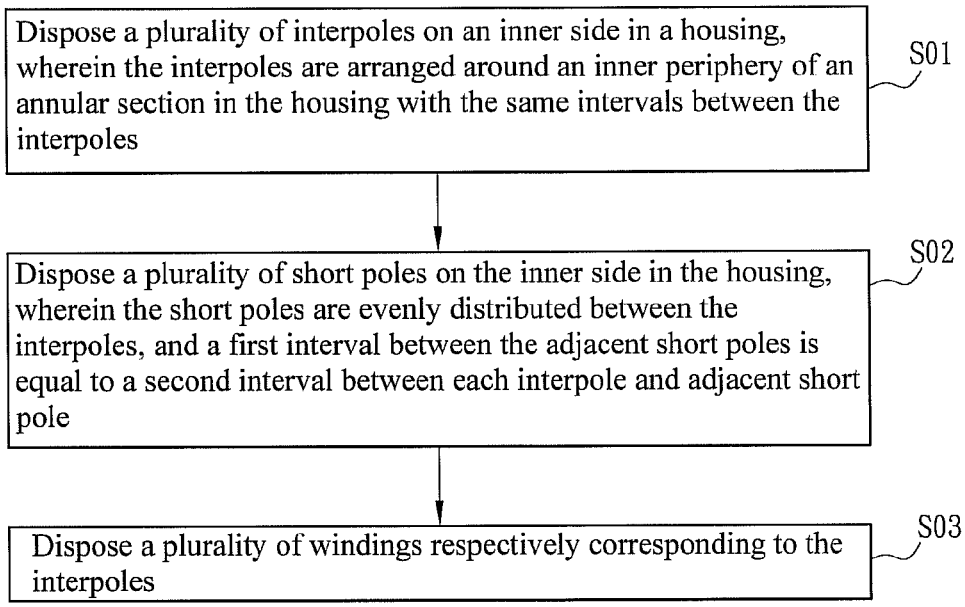
FIG. 7 shows a flow chart of a manufacturing method for the magnetic field generating module in the invention.

In addition, the manufacturing method for the magnetic field generating module 2 in the invention will be described with reference to FIGS. 7 and 2A.

The manufacturing method for the magnetic field generating module 2 includes steps S01 to S03.

In the step S01, a plurality of interpoles 22 is disposed on an inner side 211 in a housing 21. The interpoles 22 are arranged around an inner periphery of an annular section in the housing 21 with the same intervals between the interpoles 22. Herein, three specific interpoles 221 to 223 are disposed on the inner side 211 in the housing 21, and evenly arranged around the inner periphery of the annular section in the housing 21, so that the same intervals are formed between the interpoles 22.

In the step S02, a plurality of short poles 23 is disposed on the inner side 211 in the housing 21 and evenly distributed between the interpoles 22. Wherein a first interval D1 between adjacent two of the short poles 23 is equal to a second interval D2 of each interpole 22 and one of the short poles 23 adjacent to the interpole 22. Herein, 69 short poles 23 are disposed between the specific interpoles 221 to 223 so that 23 short poles 23 are evenly allocated between the interpoles 22, and the first interval D1 is equal to the second interval D2.

In the step S03, a plurality of windings 24 is disposed corresponding to the interpoles 22, respectively. Herein, each winding 24 has a plurality of coils 241. The coils 241 are disposed corresponding to the specific interpoles 221 to 223, and are respectively located between the specific interpoles 221 to 223 and the short poles 23.

In addition, the other characteristic of the magnetic field generating module 2 has been described in the above-mentioned embodiment, and detailed descriptions thereof will be omitted.

Figure 8:
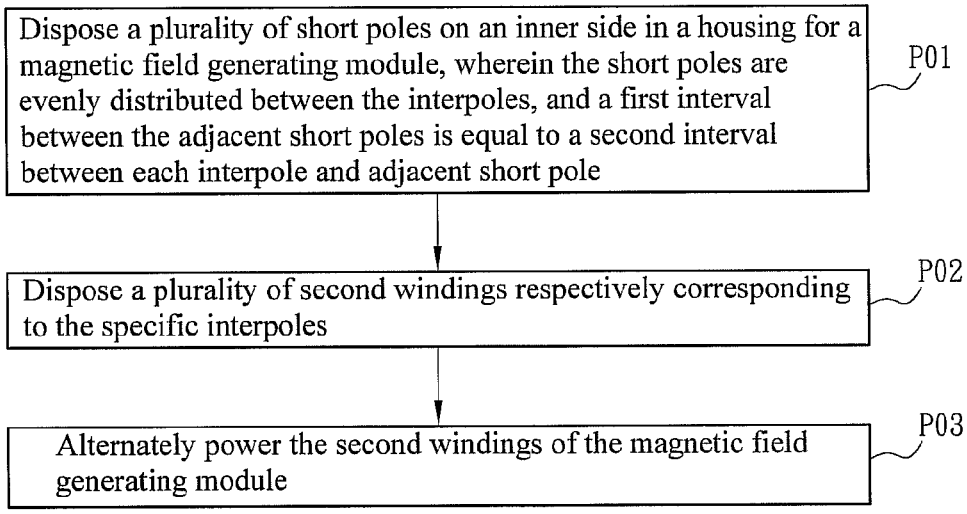
FIG. 8 shows a flow chart of a method for enhancing a magnetic force in the invention.
Figure 9A:
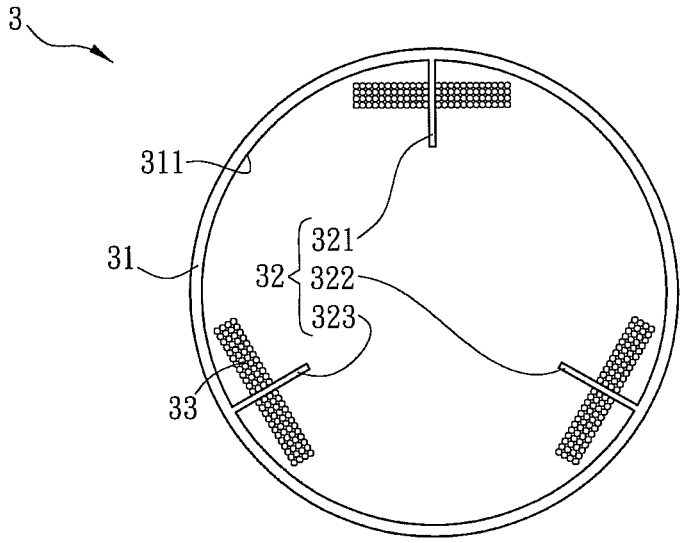
FIGS. 9A to 9D show cross-sectional views of magnetic field generating modules respectively applying the method for enhancing the magnetic force in the invention.
Figure 9B:
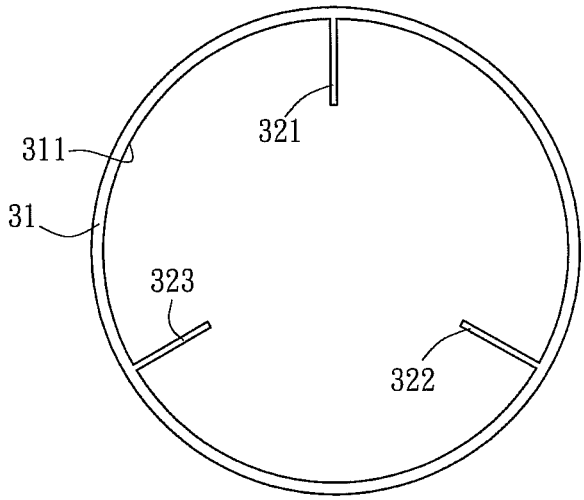

In addition, the method for enhancing the magnetic force of the invention is described with reference to FIGS. 8 and 9A. The method for enhancing the magnetic force of the invention is applied to a conventional magnetic field generating module 3, which has a housing 31. The housing 31 has an annular section. A plurality of interpoles 32 is disposed on an inner side 311 in the housing 31 and arranged around the inner periphery of the annular section with the same intervals between the interpoles 32. The magnetic field generating module has a plurality of first windings 34 disposed respectively corresponding to the interpoles 32. In this illustrative embodiment, three specific interpoles 321 to 323 are respectively disposed corresponding to the first windings 34. Of course, it is possible to dispose six or any other number of interpoles 32. In addition, the first windings 34 of the magnetic field generating module 3 have to be removed, as shown in FIG. 9B and this method can be used to enhance the magnetic force.

The method for enhancing the magnetic force of the invention includes the following steps P01 to P03.

Figure 9C:
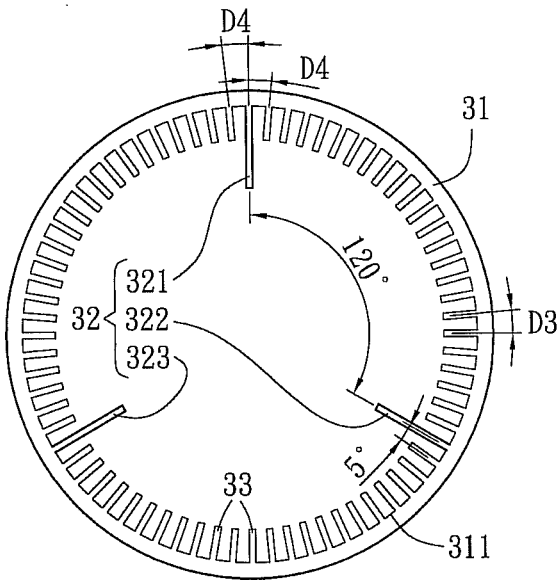

In the step P01, as shown in FIG. 9C, a plurality of short poles 33 is disposed on the inner side 311 in the housing 31 for the magnetic field generating module 3, and evenly distributed between the interpoles 32. In addition, a first interval D3 between the adjacent short poles 33 is equal to a second interval D4 between each interpole 32 and the short poles 33 adjacent to the interpole 32. Herein, 69 short poles 23 are disposed between the specific interpoles 321 to 323. So that 23 short poles 33 are evenly disposed between two interpoles 32. The first interval D3 is equal to the second interval D4. An included angle between two adjacent short poles 33 at the center point of the annular section in the housing 31 is equal to 5 degrees. An included angle between each of the specific interpoles 321 to 323 and adjacent short pole 33 at the center point of the annular section in the housing 31 is also equal to 5 degrees. Of course, a different number of short poles 33 is disposed in a manner similar to the above-mentioned embodiment.

Figure 9D:
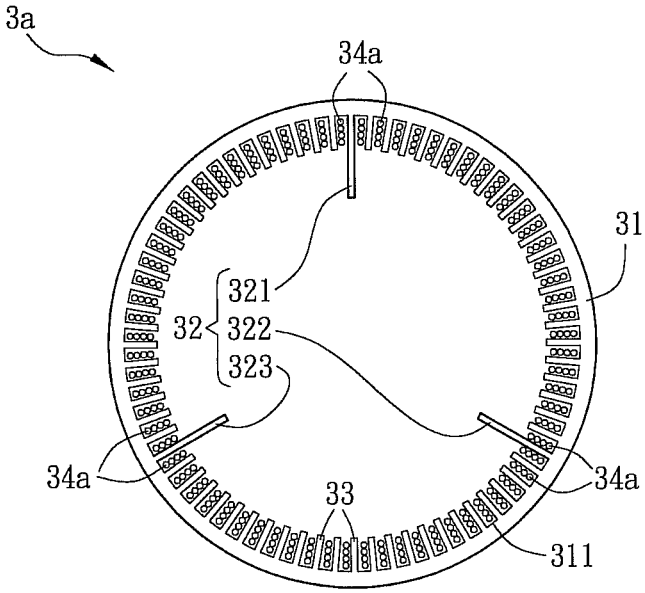

In the step P02, as shown in FIG. 9D, a plurality of second windings 34*a* is disposed respectively corresponding to the specific interpoles 321 to 323. Herein, each second winding 34*a* is disposed corresponding to each interpole 32 and the short pole 33 to complete the magnetic field generating module 3*a*.

The method for enhancing the magnetic force includes the step P03 of alternately powering the second winding 34*a* for the magnetic field generating module 3*a* to make the magnetic field generating module 3*a* generate the magnetic force.

In addition, the other technological characteristics for the magnetic field generating module 3*a* are similar to those of the magnetic field generating module 2 of the above-mentioned embodiment in the aspects for the element construction, structure and connection relationship, and detailed descriptions thereof will be omitted.

Therefore, using the method for enhancing the magnetic force according to the invention can modify the conventional structure of the magnetic field generating module 3, and can make the magnetic-line distribution become more concentrated and more uniform. In addition, the magnetic flux density and magnetic force can be effectively enhanced.

To sum up, the interpoles of the magnetic field generating module are disposed on the inner side in the housing and have the same intervals arranged around the inner periphery of the annular section in the housing. The short poles are evenly disposed between the interpoles, and the first interval is formed between the adjacent short poles. The second interval equal to the first interval is formed between each interpole and adjacent short pole. Thus, the magnetic field generating module has the magnetic interpole structure, and the design for the short pole can decrease the magnetoresistive effect of the air between two interpoles, and improve the magnetic force attenuation for the magnetic field generating module. So that the magnetic lines generated by the winding corresponding to the interpole can be effectively extended, and the magnetic-line distribution becomes more concentrated and more uniform. Thus, the magnetic field generating module in the invention has the more concentrated and more uniform magnetic-line distribution, and can effectively enhance the magnetic flux density and the magnetic force. In addition, the manufacturing method for the magnetic field generating module and the method for prompting the magnetic force have the above-mentioned structure of the magnetic field generating module. Thus, the magnetic flux density and the magnetic force are effectively enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A magnetic field generating module, comprising:

a housing having an annular section and an inner surface;

a plurality of interpoles disposed directly on the inner surface of the housing and having the same intervals arranged around an inner periphery of the annular section;

a plurality of short poles disposed directly on the inner surface of the housing and evenly distributed between the interpoles, wherein a first interval is formed between the adjacent short poles, and a second interval equal to the first interval is formed between the interpoles and the short poles adjacent to the interpole; and a plurality of windings respectively disposed corresponding to the interpoles and located between the interpoles and the short poles, wherein a length of each of the interpoles is larger than a length of each of the short poles.

2. The magnetic field generating module according to claim 1, wherein the housing is a substantially hollow cylinder.

3. The magnetic field generating module according to claim 1, wherein materials of the housing, the interpoles and the short poles comprise a magnetic-conducting material.

4. The magnetic field generating module according to claim 1, wherein the housing and at least one of the interpoles and the short poles are integrally formed.

5. The magnetic field generating module according to claim 1, wherein when the number of the interpoles is equal to three, an included angle between the interpoles at a center point of the annular section in the housing is equal to 120 degrees.

6. The magnetic field generating module according to claim 1, wherein an included angle between the adjacent short poles at a center point of the annular section in the housing is equal to 5, 10, 12 or 15 degrees.

7. The magnetic field generating module according to claim 1, wherein the number of the short poles is equal to 69, 33, 27 or 21.

8. The magnetic field generating module according to claim 1, wherein each of the windings has a plurality of coils located between the interpoles and the short poles.

* * * * *